US007798871B2

(12) United States Patent
Urano

(10) Patent No.: US 7,798,871 B2
(45) Date of Patent: Sep. 21, 2010

(54) CONTACT AND ELECTRICAL CONNECTOR HAVING INCREASED CONNECTION OBJECT REMOVAL FORCE

(75) Inventor: Tetsu Urano, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/590,587

(22) Filed: Nov. 10, 2009

(65) Prior Publication Data

US 2010/0203752 A1 Aug. 12, 2010

(30) Foreign Application Priority Data

Feb. 9, 2009 (JP) ..... 2009-027732

(51) Int. Cl.
*H01R 11/22* (2006.01)

(52) U.S. Cl. ..... 439/857; 439/818; 439/848; 439/889

(58) Field of Classification Search ..... 439/856, 439/857, 858, 861, 889, 848, 699.1, 699.2, 439/818
See application file for complete search history.

(56) References Cited

U.S. PATENT DOCUMENTS

| | | | | |
|---|---|---|---|---|
| 4,894,027 | A * | 1/1990 | Brantingham et al. | 439/699.2 |
| 4,932,891 | A * | 6/1990 | Spanke et al. | 439/856 |
| 5,501,618 | A * | 3/1996 | Muta et al. | 439/699.2 |
| 5,611,716 | A * | 3/1997 | Egenolf | 439/857 |
| 5,749,755 | A * | 5/1998 | Genta et al. | 439/856 |
| 6,045,416 | A * | 4/2000 | Sinclair | 439/857 |
| 6,296,533 | B1 * | 10/2001 | Grubbs et al. | 439/851 |
| 7,217,162 | B2 * | 5/2007 | Harada et al. | 439/857 |
| 7,291,046 | B2 * | 11/2007 | Russelburg | 439/857 |
| 7,530,828 | B2 | 5/2009 | Miyazono | |
| 7,556,515 | B2 * | 7/2009 | Kato et al. | 439/857 |
| 2008/0287011 | A1 * | 11/2008 | Piovesan | 439/818 |

FOREIGN PATENT DOCUMENTS

| | | |
|---|---|---|
| JP | 2007-095671 | 4/2007 |
| JP | 2007-280639 | 10/2007 |

* cited by examiner

*Primary Examiner*—Tho D Ta
(74) *Attorney, Agent, or Firm*—Collard & Roe, P.C.

(57) ABSTRACT

A contact has a coupling portion formed of a material which can be bent and unbent. The contact has a spring portion adapted to be connected to a first connection object and a connecting portion adapted to be connected to a second connection object. The spring portion and the connecting portion extend from the coupling portion. The coupling portion is bent into a shape surrounding an axis and maintained in the shape. An electrical connector may be formed by holding the contact in a housing.

14 Claims, 13 Drawing Sheets

CONTACT AND ELECTRICAL CONNECTOR HAVING INCREASED CONNECTION OBJECT REMOVAL FORCE

This application is based upon and claims the benefit of priority from Japanese patent application No. 2009-027732, filed on Feb. 9, 2009, the disclosure of which is incorporated herein in its entirety by reference.

TECHNICAL FIELD

This invention relates to a contact having a spring portion to be brought into press contact with a connection object and to an electrical connector using the contact.

BACKGROUND ART

An electrical connector includes a contact comprising a conductive member and adapted to be contacted with a connection object to achieve electrical connection. Generally, the contact has a spring portion movably supporting a part to be contacted with the connection object. In order to prevent the connection object connected to the electrical connector or the contact from being easily and unintentionally removed or disconnected therefrom, it is desired to increase a removal force required to remove or disconnect the connection object. For this purpose, various improvements have been made to the electrical connector or the contact as will presently be described.

JP-A-2007-95671 (Patent Document 1) discloses an electrical connector comprising a movable operating member. The movable operating member operates a contact to bring the contact into press contact with a connection object. Thus, a removal force required to remove the connection object is increased.

JP-A-2007-280639 (Patent Document 2) discloses a contact having a structure in which three spring elements intersecting with one another are brought into press contact with a connection object in order to increase a removal force required to remove the connection object.

SUMMARY OF THE INVENTION

However, the electrical connector disclosed in Patent Document 1 requires the operating member as a separate component in addition to the contact. Therefore, the number of parts is increased and cost reduction is difficult. Furthermore, if the operating member is formed of synthetic resin, the operating member may possibly be deformed due to heat. When the operating member is deformed, the removal force required to remove the connection object is decreased. On the other hand, if the operating member is formed of metal, another problem will arise. That is, in case of insufficient contact between the operating member and the contact when the operating member is butted against the contact, electric discharge may possibly occur. Further, if the electrical connector is subjected to vibration, this may result in a problem of unstable contact.

The contact disclosed in Patent Document 2 comprises three spring elements and therefore has a complicated structure and a large outer dimension. Furthermore, because of the structure in which the spring elements intersecting with one another are brought into contact with the connection object, the connection object is subjected to a shearing force in a contacted state. This may result in lack of long-term reliability.

It is therefore an exemplary object of this invention to provide a contact which is capable of increasing a removal force required to remove a connection object without requiring an increased number of parts and with a relatively simple structure.

It is another exemplary object of this invention to provide an electrical connector using the above-mentioned contact.

Other objects of the present invention will become clear as the description proceeds.

According to an exemplary aspect of the present invention, there is provided a contact which comprises a coupling portion, a spring portion which extends from the coupling portion and is adapted to be connected to a first connection object, and a connecting portion which extends from the coupling portion and is adapted to be connected to a second connection object, wherein the coupling portion is maintained in a shape bent to surround an axis.

According to another exemplary aspect of the present invention, there is provided an electrical connector which comprises the above-mentioned contact and a housing holding the contact.

According to still another exemplary aspect of the present invention, there is provided a combination of the above-mentioned contact and a shape maintaining portion which maintains the coupling portion in a bent shape.

EXEMPLARY EMBODIMENT

Figure 1A:
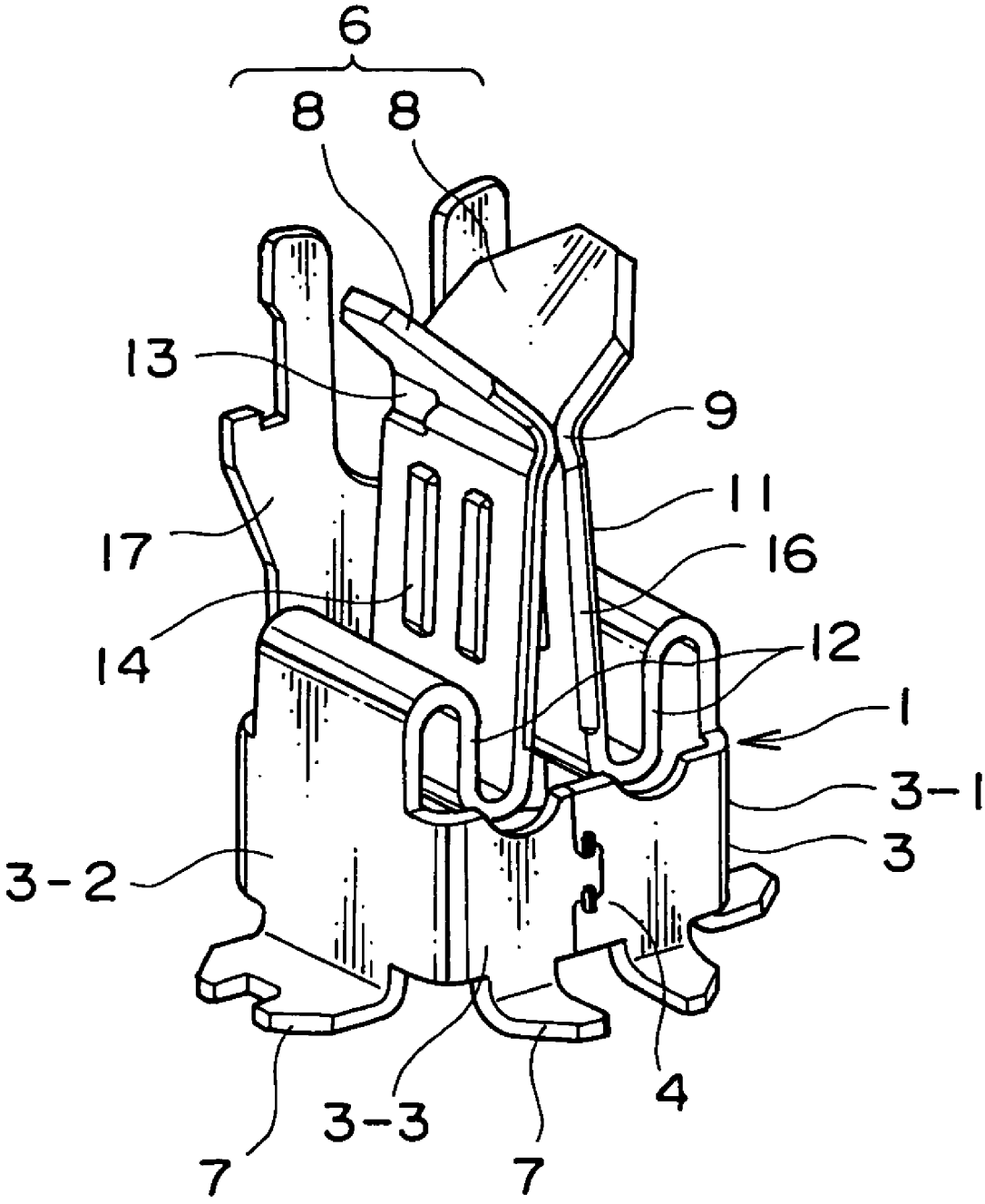
FIG. 1A is a perspective view of a contact according to an embodiment of this invention.
Figure 1B:
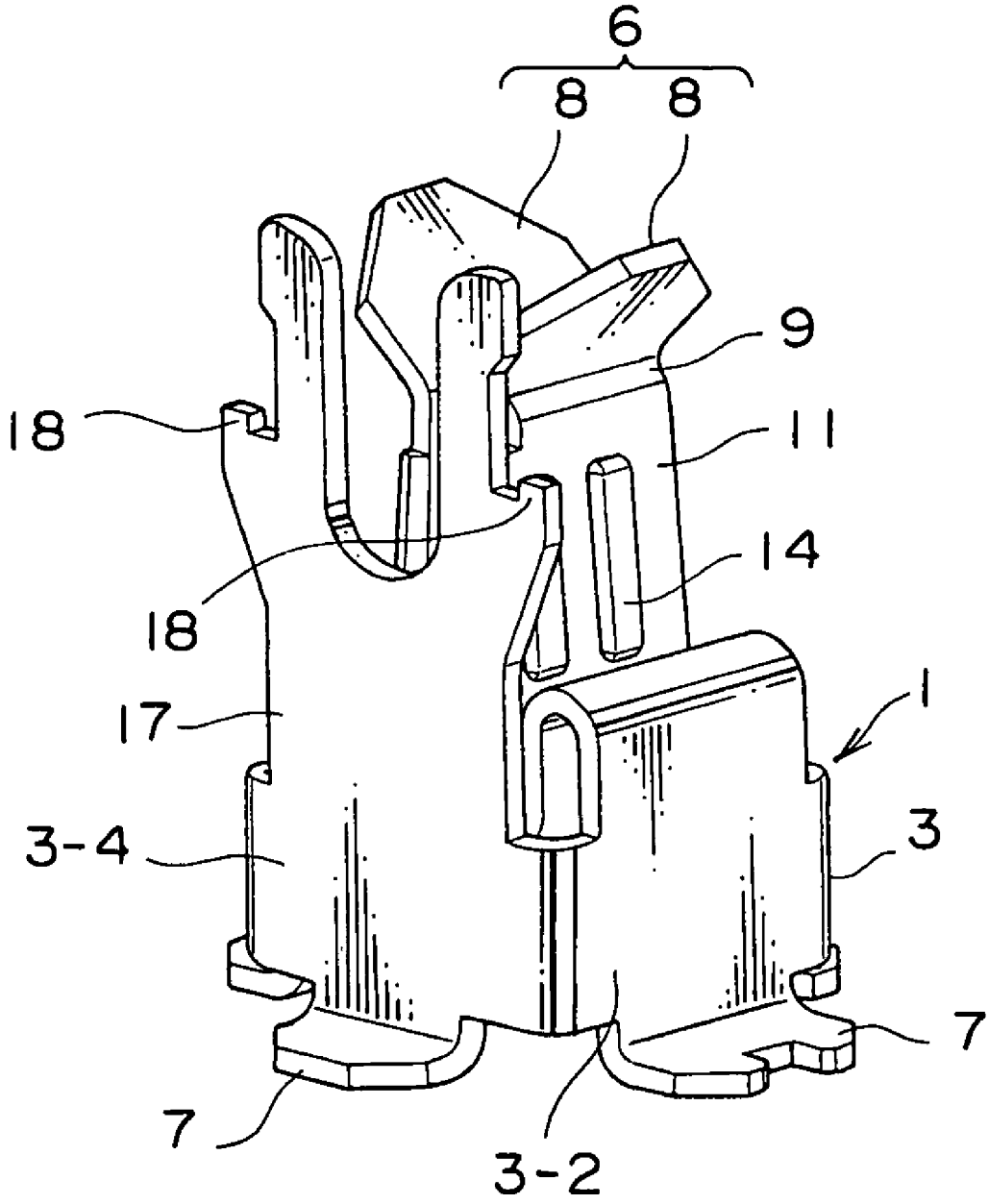
FIG. 1B is a perspective view of the contact in FIG. 1A as seen in a different direction.

At first referring to FIGS. 1A to 1C, description will be made of an overall structure of a contact according to an embodiment of this invention.

The contact depicted by a reference numeral 1 in the figure is integrally formed of a conductive plate material. The contact 1 has a coupling portion 3 formed into a generally rectangular cylindrical shape to surround an axis 2 vertically extending on a plane of drawing sheet in FIG. 1C. The coupling portion 3 comprises a plate-like portion which can be bent and unbent (namely, extended or spread). The cylindrical shape of the coupling portion 3 is maintained by a shape maintaining portion 4 comprising a joint or a joining portion formed on at least one surface of the coupling portion 3.

The coupling portion 3 of the generally rectangular cylindrical shape has a pair of plate portions 3-1 and 3-2 faced to each other and another pair of plate portions 3-3 and 3-4 faced to each other. Furthermore, the coupling portion 3 has an upper end face 3*a* and a lower end face 3*b* which face a direction parallel to the axis 2.

The contact 1 has a spring portion 6 extending from the upper end face 3*a* of the coupling portion 3 and adapted to be connected to a first connection object such as an elongated lamp tube (for example, a cold cathode tube) having translucency. Furthermore, the contact 1 has a plurality of connecting portions 7 extending from the lower end face 3*b* of the coupling portion 3 and adapted to be surface-mounted and connected to a second connection object, such as a printed board.

The spring portion 6 has a pair of spring elements 8 elastically displaceable in a direction perpendicular to the axis 2. The spring elements 8 extend from the plate portions 3-1 of 3-2 of the coupling portion 3 which are faced to each other, respectively. The plate portion 3-3 of the coupling portion 3 is provided with the joint forming the shape maintaining portion 4. The joint is composed of a recess formed on one side and a protrusion formed on the other side. Specifically, the recess and the protrusion are formed on confronting end faces of the coupling portion 3 bent into the cylindrical shape. The recess and the protrusion are fitted to each other. Then, a boundary between the recess and the protrusion is pressed and deformed or crushed by caulking or swaging. Thus, the recess and the protrusion are engaged with each other in a circumferential direction around the axis 2. Herein, a combination of the recess and the protrusion may be referred to an engaging portion which will far later be described.

The spring elements 8 have butting portions 9 butted against each other with a preload as will later be described, contacting portions 11 adapted to be contacted with the first connection object, and meandering portions 12 for effectively obtaining elastic displacement, respectively. Each of the meandering portions 12 is formed in an S-shape in section and may therefore be called an S-shaped portion. The meandering portions 12 increase flexibility of the spring elements 8 and therefore have an effect of preventing the first connection object from being damaged during a connecting operation.

Each of the spring elements 8 has a projecting portion 13 to be engaged with the first connection object in a removal direction along the axis 2 (an upward direction on the plane of drawing sheet in FIG. 1C) when the first connection object is contacted with the contacting portion 11. In the illustrated example, the projecting portion 13 is formed at a position corresponding to the butting portion 9 or in the vicinity thereof by pressing a rear part of the spring element 8 from the outside. The projecting portion 13 will later be described in detail.

Each of the contacting portions 11 has a shape adapted to be contacted with a terminal of the first connection object, i.e., has concave portions. Specifically, each spring element 8 is provided with convex portions 14 produced as a result of press-forming the concave portions on an inner surface of the contacting portion 11, and chamfered portions 16 formed on opposite ends of the inner surface of the contacting portion 11. The concave portions provide multi-point contact with the terminal of the first connection object to improve contacting reliability. Furthermore, the concave portions providing the convex portions 14 serve to reduce a contacting area when the first connection object is connected. It is therefore possible to reduce the amount of grinding dust generated when the first connection object is connected. The chamfered portions 16 also contribute to reduction of the amount of grinding dust.

The contact 1 illustrated in the figure further includes a stopper plate 17 extending upward from the upper end face 3*a* of the plate portion 3-4 of the coupling portion 3. The stopper plate 17 serves to protect the spring elements 8 and to limit a position of the first connection object in a direction along the axis 2 when the first connection object is connected. The stopper plate 17 has connected portions 18 which have been connected to a portion generally called a carrier when a number of contacts 1 are continuously and automatically formed from a belt-like plate material.

The above-mentioned contact 1 is capable of increasing the removal force required to remove the connection object without requiring an increased number of parts and with a relatively simple structure.

Figure 2A:
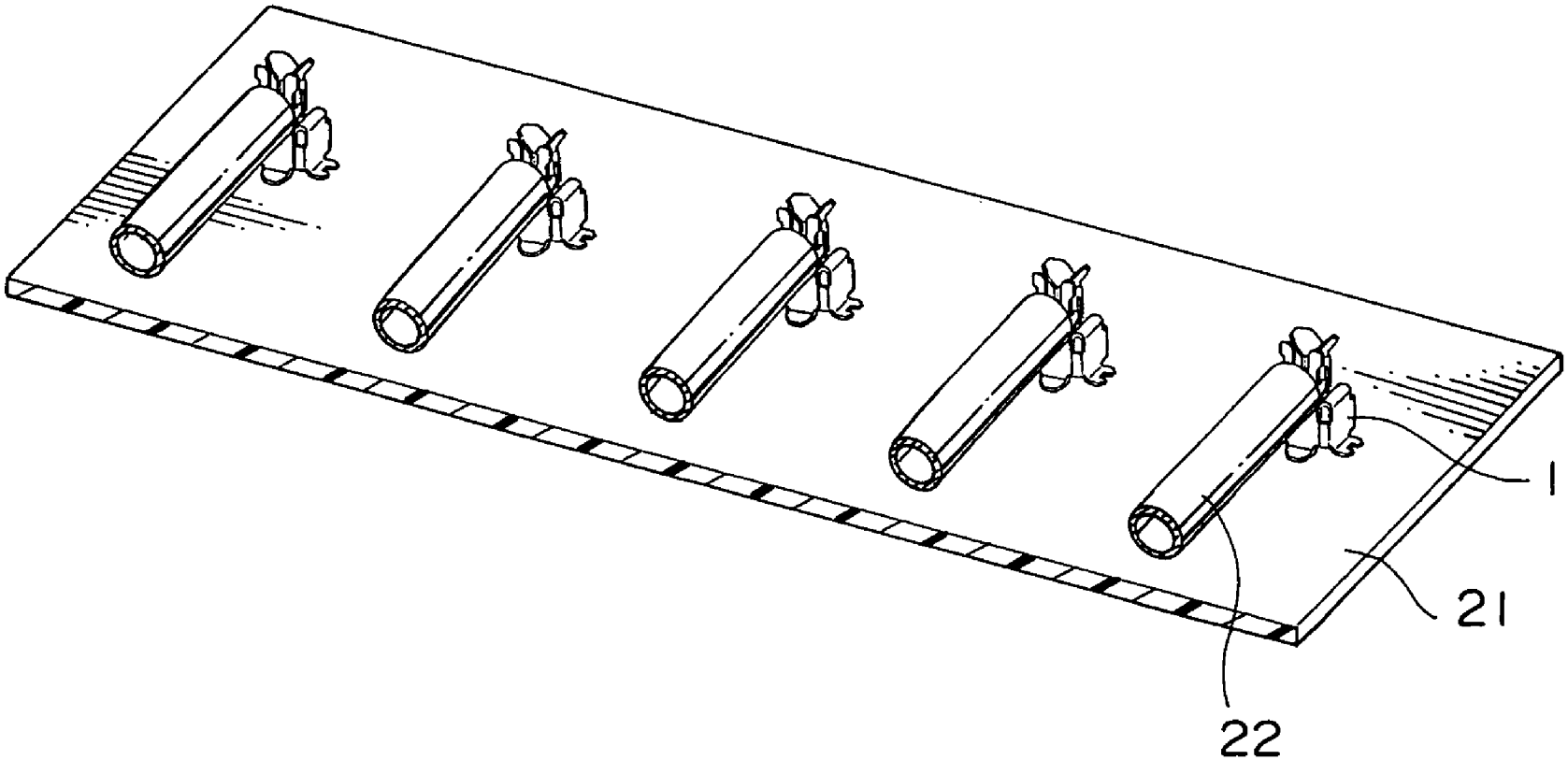
FIG. 2A is a perspective view showing an example how the contact illustrated in FIGS. 1A and 1B is used.
Figure 2B:
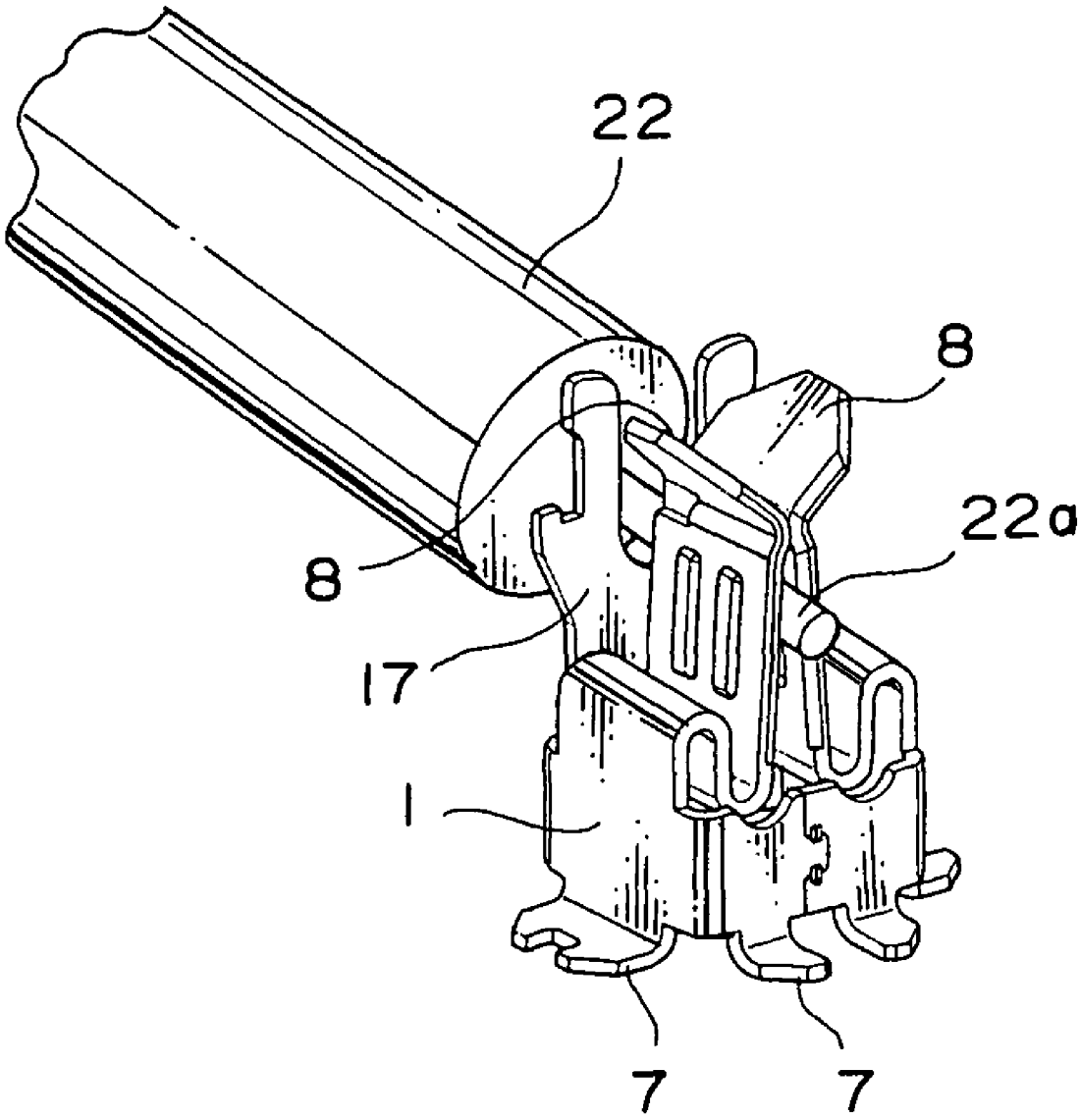
FIG. 2B is an enlarged perspective view showing a part in FIG. 2A.

Referring to FIGS. 2A and 2B, description will be made of an example how the above-mentioned contact 1 is used.

In FIGS. 2A and 2B, a plurality of the contacts 1 are disposed on a printed board 21 as the second connection object and spaced apart from one another. To each contact 1, a cold cathode tube 22 is connected as the first connection object. In detail, a connection terminal 22*a* of the cold cathode tube 22 is inserted between the spring elements 8.

Figure 3:
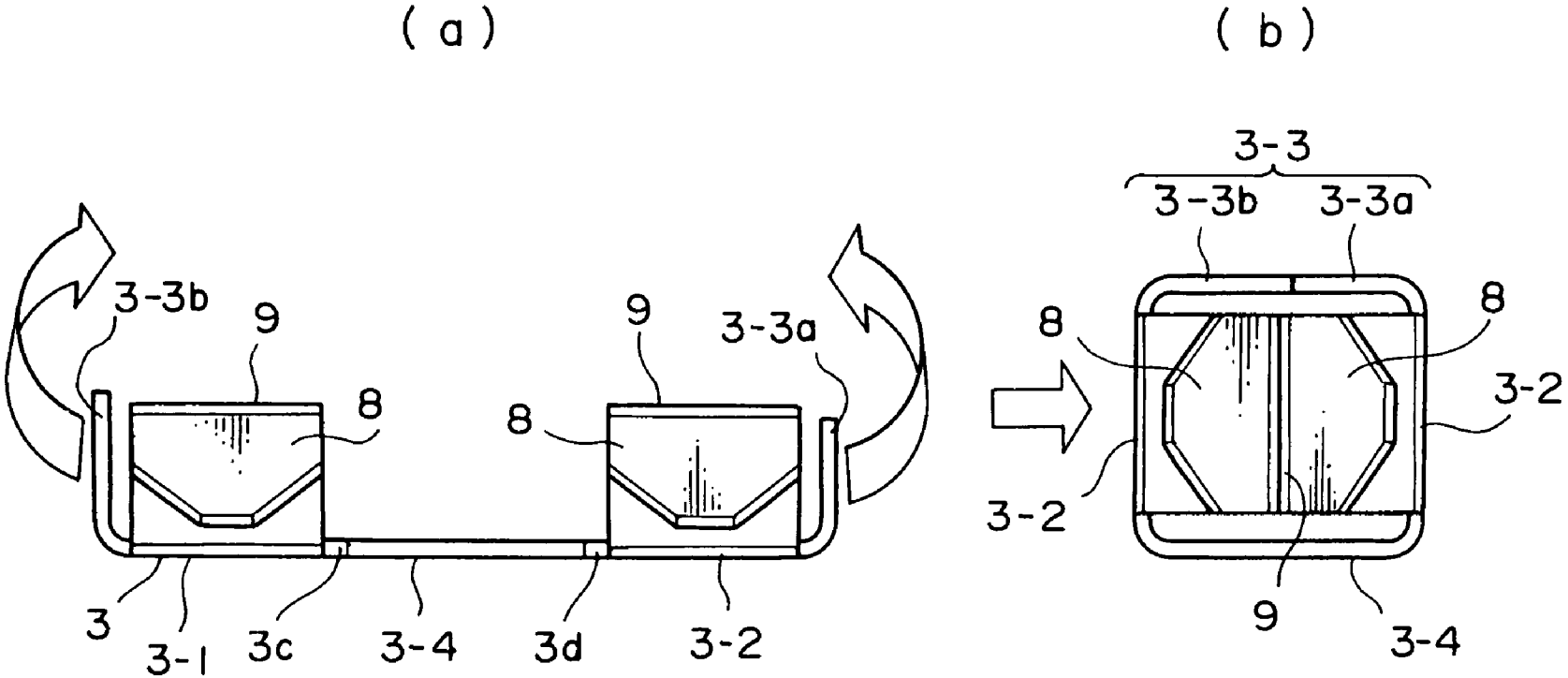
FIG. 3 is a view for describing a method of manufacturing the contact illustrated in FIGS. 1A to 1C.

Referring to FIG. 3, description will be made of a method of producing the above-mentioned contact 1. In order to integrally form the contact 1 using a plate material, the plate portions 3-1, 3-2, and 3-3 are at first formed in a linear shape, as shown in (a) in FIG. 3. In this state, the spring elements 8 are separated from each other. The plate portion 3-3 to be provided with the joint is formed as two split parts 3-3*a* and 3-3*b*. The split parts 3-3*a* and 3-3*b* are preliminary bent at a substantially right angle with respect to the plate portions 3-1, 3-2, and 3-4. The two split parts 3-3*a* and 3-3*b* forming the plate portion 3-3 are provided at their end faces with the recess and the protrusion mentioned above, respectively.

Next, the coupling portion 3 is bent at a right angle at two bending portions 3*c* and 3*d* so that the spring elements 8 are faced to each other and the butting portions 9 are butted against each other. Then, the spring elements 8 are elastically deformed and the split parts 3-3*a* and 3-3*b* are moved toward each other so that the recess and the protrusion are fitted to each other. In this state, the boundary between the recess and the protrusion is deformed in a thickness direction so that the split parts 3-3*a* and 3-3*b* are engaged with each other to form the plate portion 3-3 as an integral portion. Thus, it is possible to easily obtain a state where the butting portions 9 of the spring elements 8 are butted against each other with a so-called preload.

Since the spring elements 8 are preloaded as mentioned above, base portions (namely, the plate portions 3-1 and 3-2 of the coupling portion 3) of the spring elements 8 are applied with a force in a direction away from each other, i.e., in a widening direction and attempt to widen away from each other. In order to prevent the base portions of the spring elements 8 (the plate portions 3-1 and 3-2 of the coupling portion 3) from widening away from each other, the coupling portion 3 is provided with the shape maintaining portion 4. Thus, a contacting pressure of the spring elements 8 is kept at a proper level.

Figure 4:
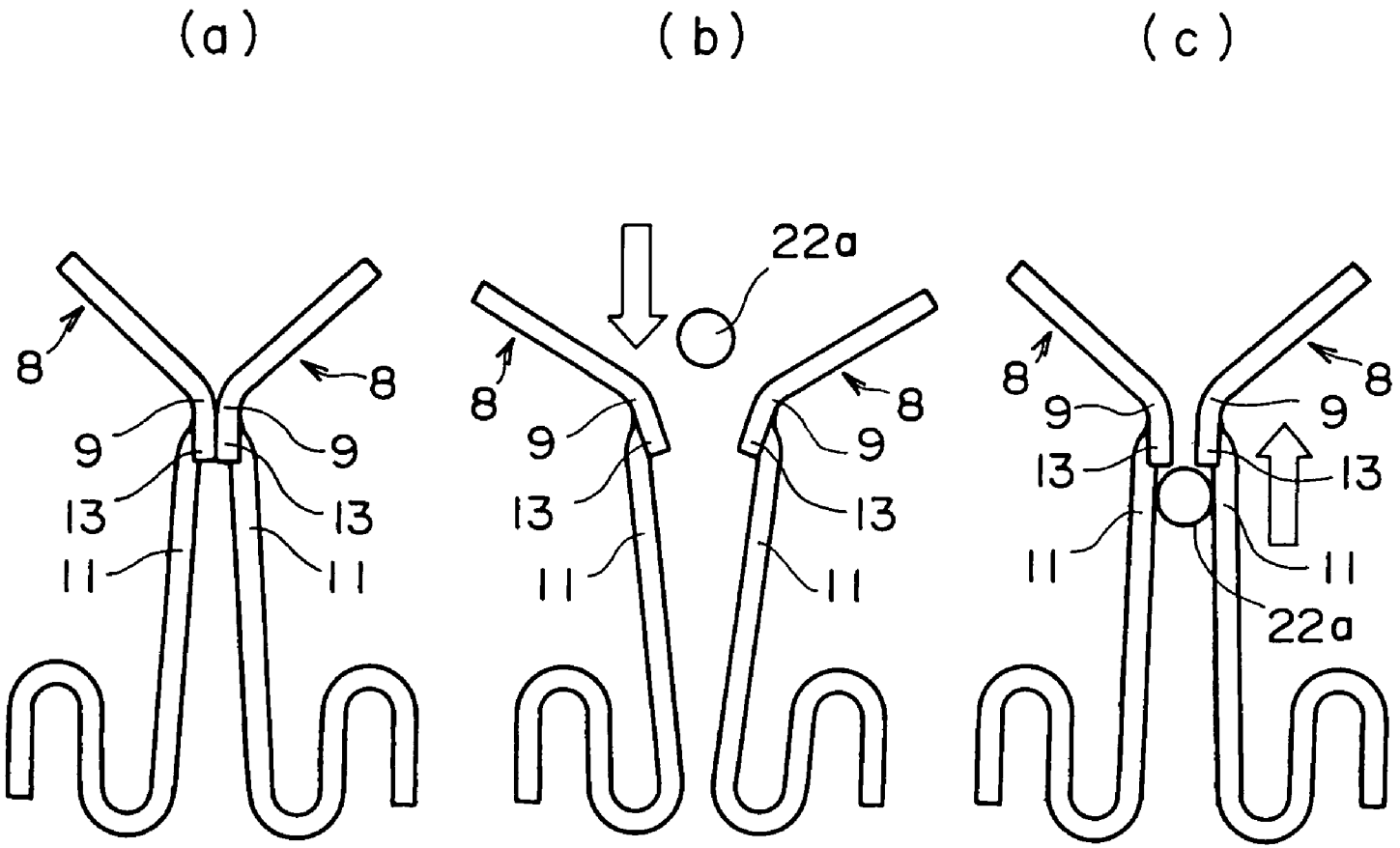
FIG. 4 is a view for describing an operation of connecting the contact illustrated in FIGS. 1A to 1C and a connection object.

Referring to FIG. 4, the above-mentioned contact 1 will be described in relation to the cold cathode tube 22.

In FIG. 4, (a) shows an initial state where the butting portions 9 of the spring elements 8 are butted against each other. As shown at (b) in FIG. 4, the butting portions 9 are separated from each other and the connection terminal 22*a* of the cold cathode tube is inserted between the spring elements 8. Thereafter, as shown at (c) in FIG. 4, the contacting portions 11 are contacted with the connection terminal 22*a* under a restoring force of the spring elements 8. In this state, the connection terminal 22*a* is tightly clamped by the contacting portions 11 under the above-mentioned preload. Therefore, it is possible to increase the removal force required to remove the cold cathode tube when the cold cathode tube is attempted to be forcibly removed. Furthermore, the projecting portions 13 serve as an obstacle to inhibit release of the connection terminal 22*a* from a position between the spring elements 8. Thus, the cold cathode tube is electrically and mechanically connected to the contact 1.

Figure 5:
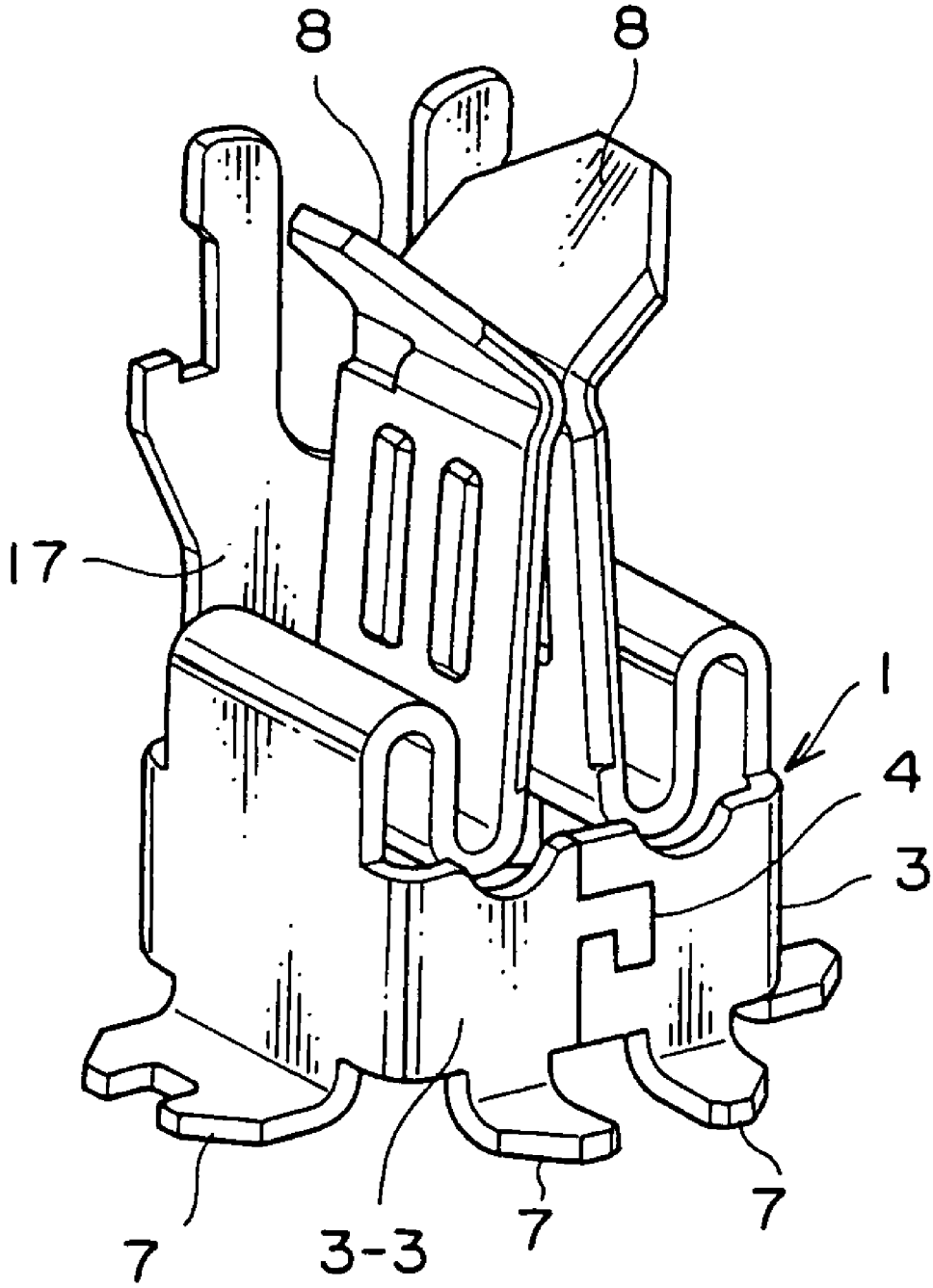
FIG. 5 is a perspective view of a first modification of the contact illustrated in FIGS. 1A to 1C.

As shown in FIG. 5, the joint forming the shape maintaining portion 4 may be obtained by a combination of a recess and a protrusion which are preliminarily shaped so as to be engaged with each other in the circumferential direction.

Figure 6A:
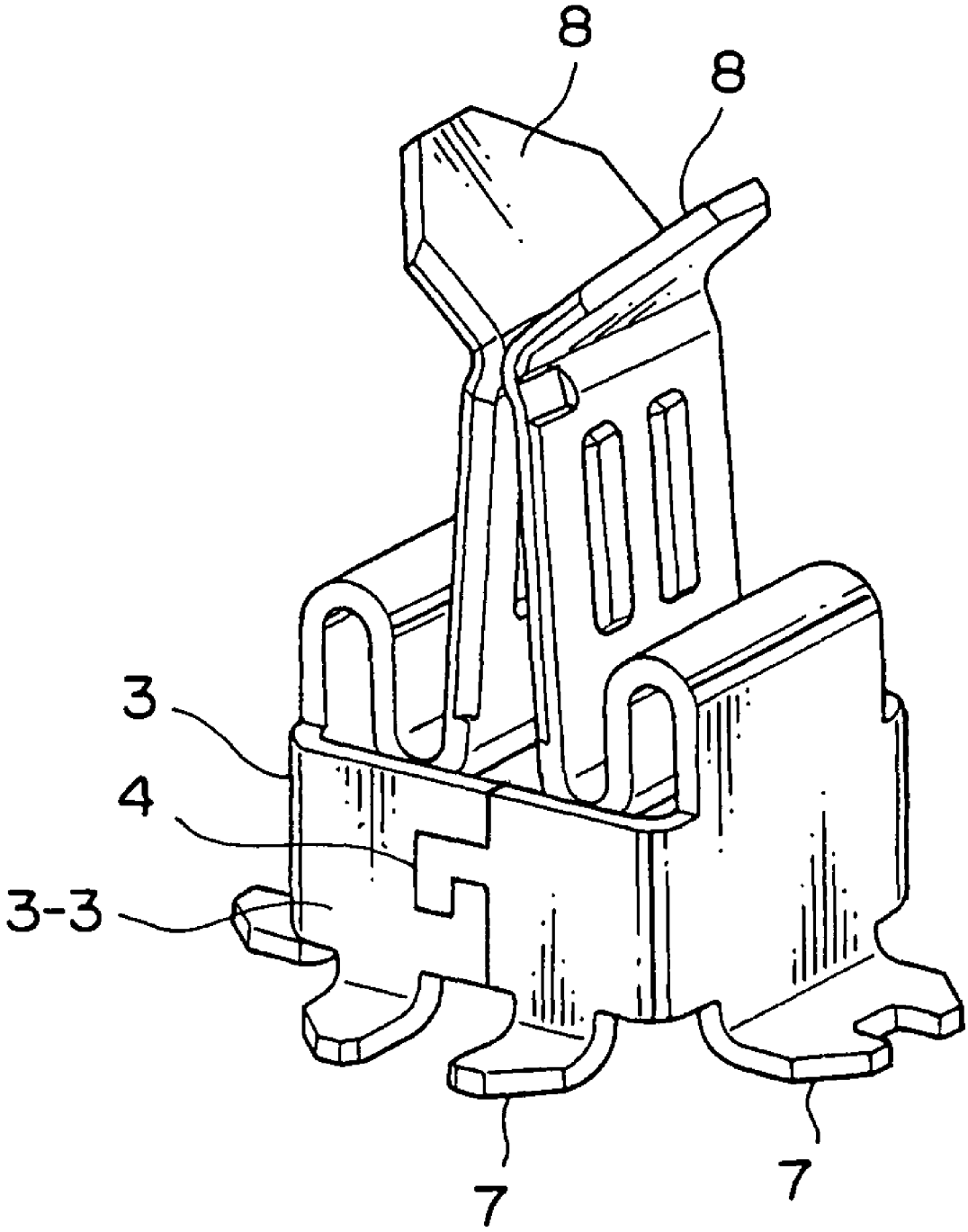
FIG. 6A is a perspective view of a second modification of the contact illustrated in FIGS. 1A to 1C.
Figure 6B:
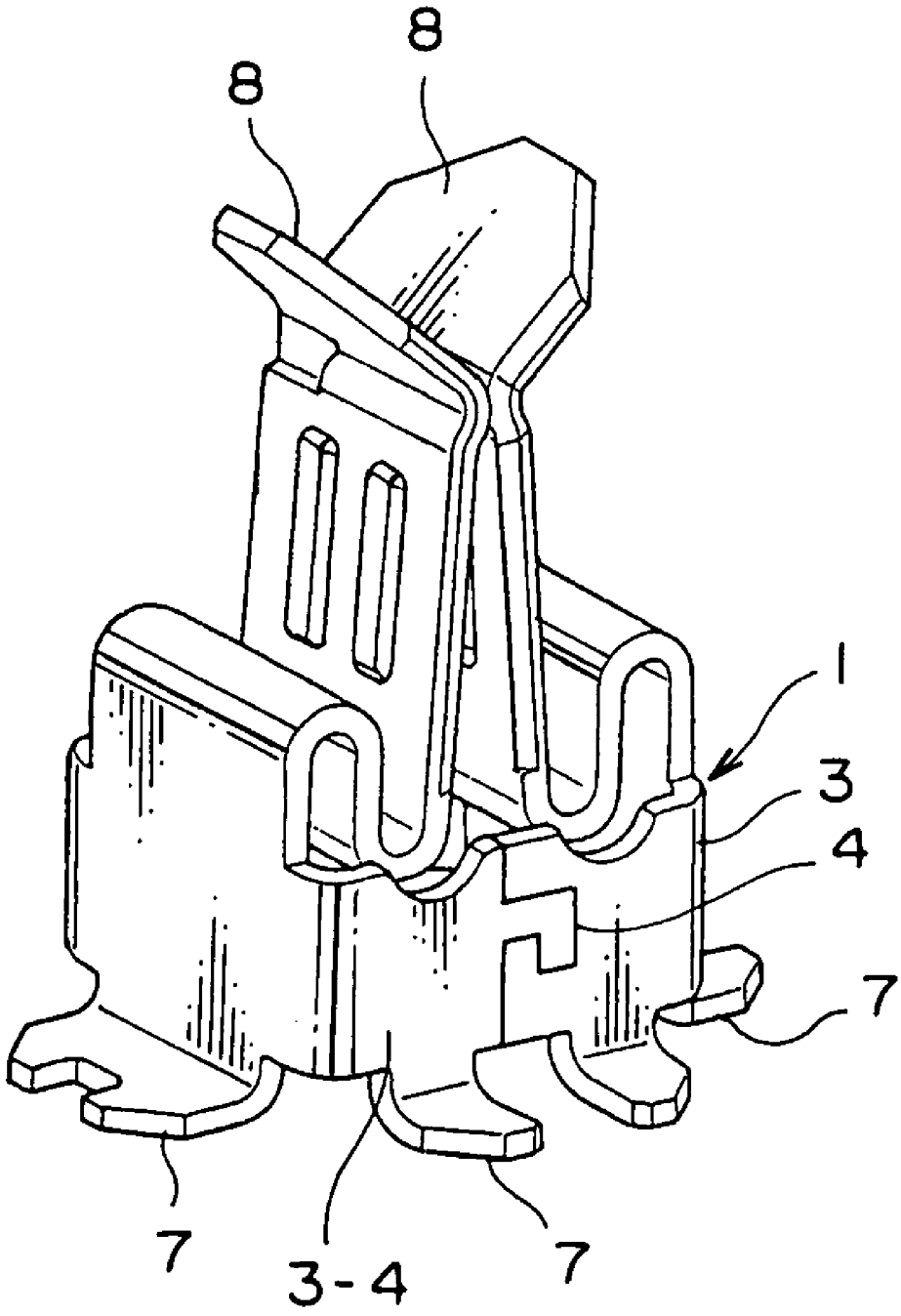
FIG. 6B is a perspective view of the second modification illustrated in FIG. 6A.

As shown in FIGS. 6A and 6B, the joint forming the shape maintaining portion 4 may be formed on each of the plate portions 3-3 and 3-4 at a front side and a rear side of the contact 1. Similar modification may be applied to the embodiment illustrated in FIGS. 1A to 1C.

Referring to FIGS. 7 to 11, various modifications of the projecting portions 13 will be described.

Figure 7:
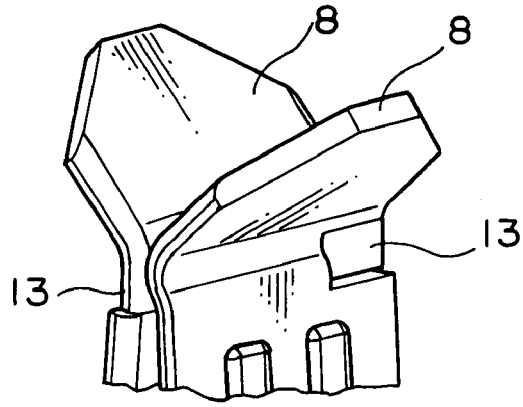
FIG. 7 is a perspective view of a characteristic part of a third modification of the contact illustrated in FIGS. 1A to 1C.

In the foregoing, the projecting portions 13 are formed only at the rear parts of the spring elements 8. However, as illustrated in FIG. 7, the projecting portions 13 may be formed at a front side of one of the spring elements 8 and at a rear side of the other spring element 8.

Figure 8:
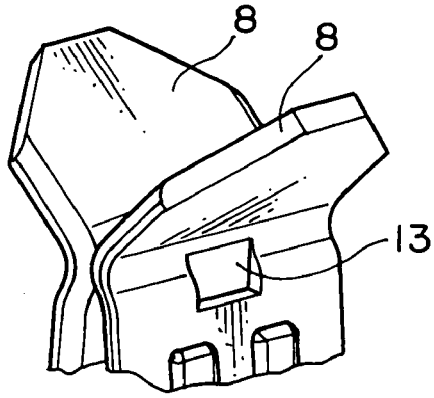
FIG. 8 is a perspective view of a characteristic part of a fourth modification of the contact illustrated in FIGS. 1A to 1C.

As illustrated in FIG. 8, the projecting portion 13 may be formed at a center in a back-and-forth direction in at least one of the spring elements 8.

Figure 9:
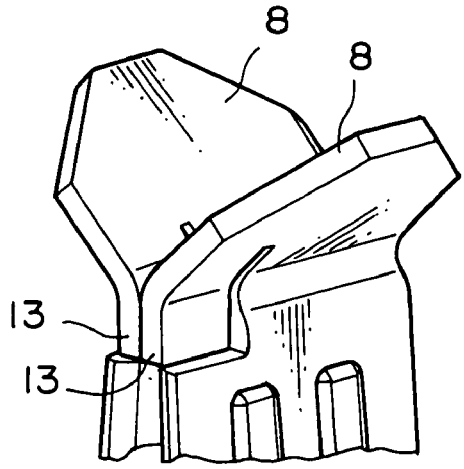
FIG. 9 is a perspective view of a characteristic part of a fifth modification of the contact illustrated in FIGS. 1A to 1C.

As illustrated in FIG. 9, the projecting portions 13 may be formed by cutting the spring elements 8.

Figure 10:
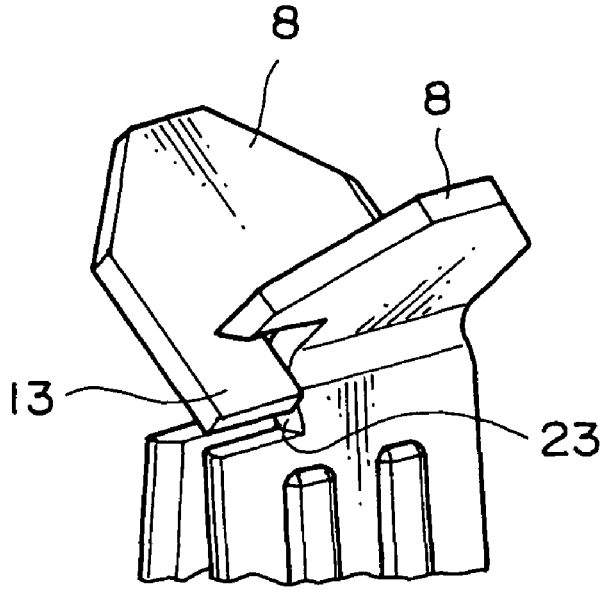
FIG. 10 is a perspective view of a characteristic part of a sixth modification of the contact illustrated in FIGS. 1A to 1C.

Referring to FIG. 10, one of the spring elements 8 is cut to form the projecting portion 13. The other spring element 8 is provided with a cutout 23. The projecting portion 13 is linearly extended to be placed in the cutout 23. In this case, the projecting portion 13 extends across confronting surfaces of the spring elements 8.

Figure 11:
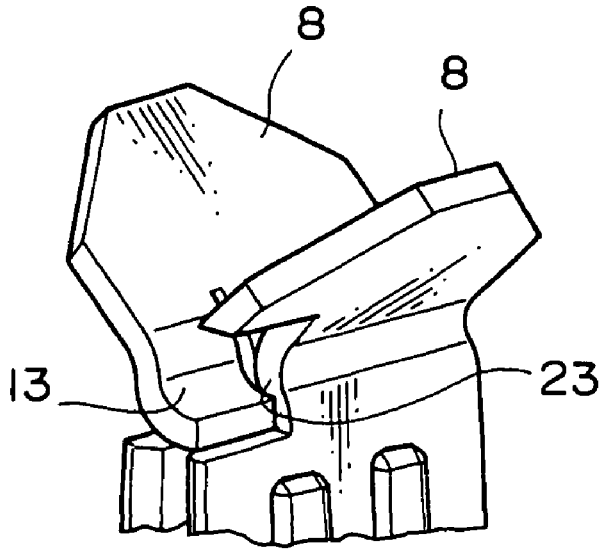
FIG. 11 is a perspective view of a characteristic part of a seventh modification of the contact illustrated in FIGS. 1A to 1C.

Referring to FIG. 11, the projecting portion 13 may be appropriately bent.

It will readily be understood that the structures illustrated in FIGS. 7 to 11 may be combined in various manners.

In the above-mentioned contact 1, the engaging portions are formed at the joint of the coupling portion 3. However, the shape of the coupling portion 3 may be maintained by any other appropriate means.

For example, in case where the contact 1 is mounted to the printed board 21 and the connecting portions 7 are fixed to the printed board 21, the shape of the coupling portion 3 can be maintained by the printed board 21. In this case, a part of the printed board 21 serves as a shape maintaining portion.

Alternatively, as a shape maintaining portion, the contact 1 may be provided with a fixing portion fixing a bending angle of the bending portions 3*c* and 3*d* of the coupling portion 3.

In the above-mentioned contact 1, the coupling portion 3 extends in an annular shape around the axis 2. However, the coupling portion 3 may not extend in an annular shape but may extend in a curved shape around the axis 2 with a part opened.

Figure 12:
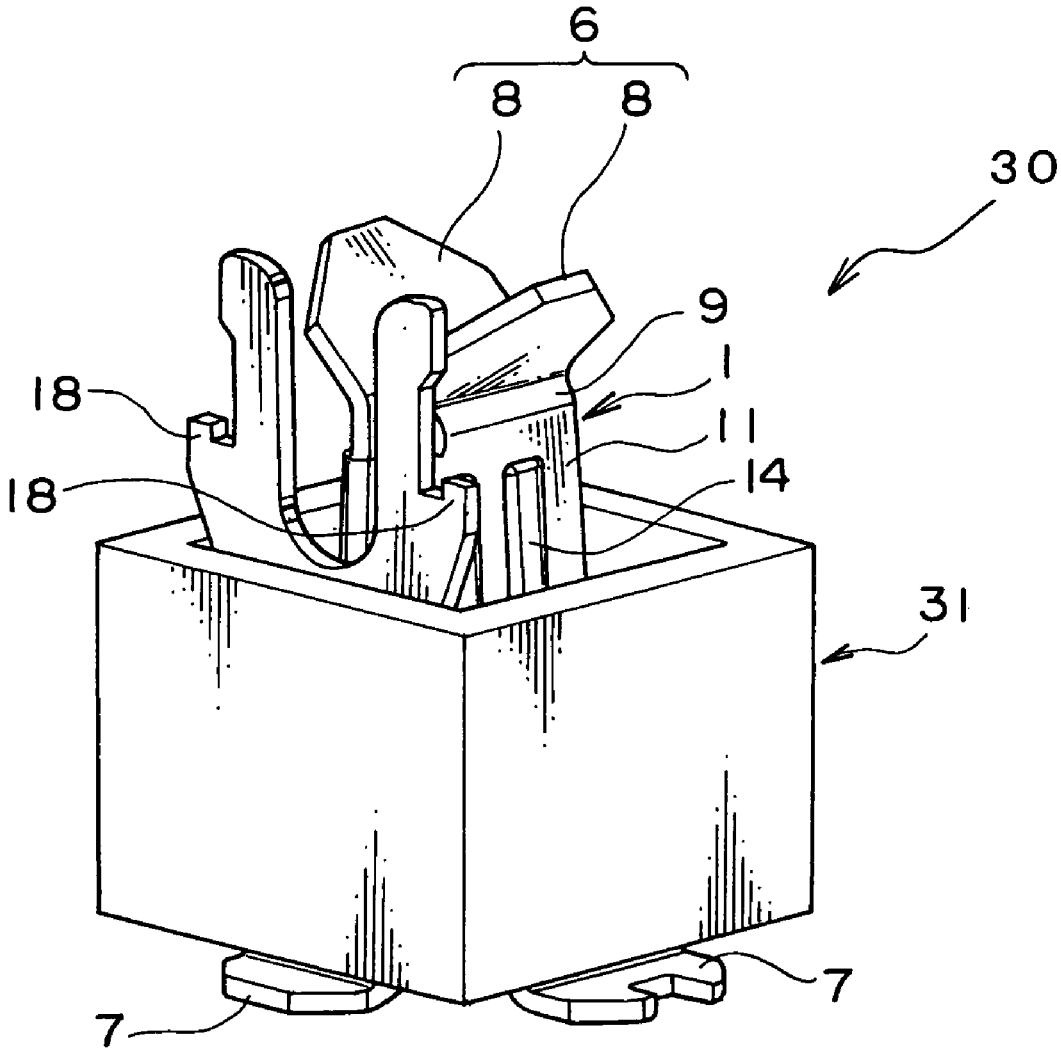
FIG. 12 is a perspective view of an electrical connector according to another embodiment of this invention, wherein the electrical connector includes the contact illustrated in FIGS. 1A to 1C.

Referring to FIG. 12 here, the description will be directed to an electrical connector according to another embodiment of this invention.

The electrical connector is depicted by a reference numeral 30 in the figure and includes the contact 1 illustrated in FIGS. 1A to 4, and an insulating housing 31 holding the contact 1. More particularly, the contact 1 is securely assembled in the insulating housing 31 that is of a rectangular cylindrical shape.

Figure 1C:
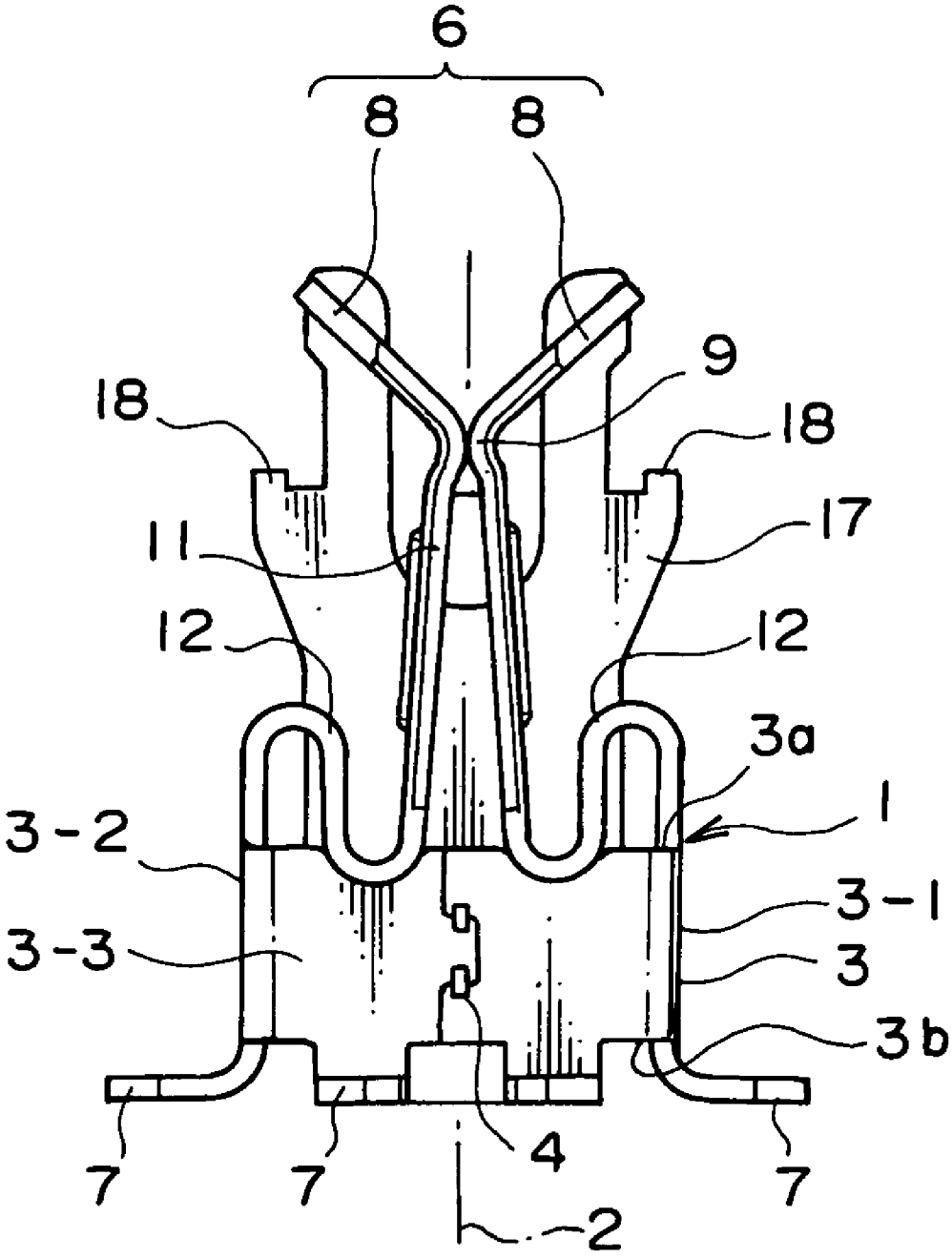
FIG. 1C is a front view of the contact illustrated in FIGS. 1A and 1B.

With the electrical connector 30, a part of the housing 31 serves as a shape maintaining portion and maintains the coupling portion 3 in a shape bent to surround the axis 2 as shown in FIG. 1C.

Each of various contacts 1 illustrated in FIGS. 5-11, respectively, can be assembled in the insulating housing 31 to form the electrical connector 30.

Various exemplary embodiments of this invention will be enumerated in the following items 1-15.

1. A contact 1 comprising:

a coupling portion 3;

a spring portion 6 which extends from the coupling portion 3 and is adapted to be connected to a first connection object (22); and a connecting portion which extends from the coupling portion 3 and is adapted to be connected to a second connection object (21);

wherein the coupling portion 3 is maintained in a shape bent to surround an axis 2.

The contact of item 1 is applicable to connection of a cold cathode tube, such as a backlight of a liquid crystal display.

2. The contact 1 according to item 1, wherein the spring portion 6 comprises a pair of spring elements 8 elastically displaceable in a direction intersecting the axis 2, the spring elements 8 comprise butting portions 9 and contacting portions 11, respectively, the butting portions are butted against each other with a preload, and the contacting portions 11 are adapted to be contacted with the first connection object (22).

3. The contact 1 according to item 2, wherein at least one of the spring elements 8 has a projecting portion 13 which prevents the first connection object (22) from moving in a removal direction along the axis 2 when the first connection object (22) is contacted with the contacting portions 11.

4. The contact 1 according to item 2, wherein each of the contacting portions 11 is formed into a shape adapted to be contacted with a lamp tube as the first connection object.

5. The contact 1 according to anyone of items 1-3, further comprising a shape maintaining portion 4 which maintains the coupling portion 3 in a bent shape.

6. The contact 1 according to item 5, wherein the shape maintaining portion 4 includes a fixing portion which is coupled to the coupling portion 3 to fix the shape of the coupling portion 3.

7. The contact 1 according to item 5 or 6, wherein the shape maintaining portion 4 consists of a joint which is formed at least one position of the coupling portion 3.

8. The contact 1 according to item 7, wherein the joint is formed by mutual engagement in a circumferential direction with respect to the axis 2.

9. The contact 1 according to item 7 or 8, wherein the coupling portion 3 is formed into a generally rectangular cylindrical shape defining four surfaces, the spring elements 8 extend from opposite ones of the four surfaces, respectively, the joint is formed on at least one of the remaining ones of the four surfaces.

10. The contact 1 according to anyone of items 1-9, wherein the coupling portion 3 extends in an annular shape around the axis 2.

11. The contact 1 according to anyone of items 1-10, wherein the coupling portion 3 extend in a curved shape around the axis 2.

12. An electrical connector 30 comprising:

the contact 1 according to anyone of items 1-11; and a housing 31 holding the contact 1.

The electrical connector 30 of item 12 is applicable to connection of a cold cathode tube, such as a backlight of a liquid crystal display.

13. The electrical connector 30 according to item 12, wherein the housing 31 includes a shape maintaining portion 4 which maintains the coupling portion 3 in a bent shape.

14. A combination of the contact 1 according to anyone of items 1-11 and a shape maintaining portion 4 which maintains the coupling portion 3 in a bent shape.

15. The combination according to item 14, wherein the shape maintaining portion 4 is a part of a board to which the contact 1 is mounted.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A contact comprising:

a coupling portion maintained in a bent shape bent to surround an axis;

a spring portion which extends from the coupling portion and is for connecting a first connection object; and a connecting portion which extends from the coupling portion and is for connecting a second connection object;

wherein the spring portion comprises a pair of spring elements elastically displaceable in a first direction intersecting the axis, the spring elements are provided with butting portions and contacting portions, respectively, the butting portions are butted against each other with a preload caused by elasticity of the spring elements, and the contacting portions are formed to be contacted with the first connection object, and wherein one of the spring elements is further provided with a first projecting portion which is for preventing the first connection object from moving in a removal direction along the axis when the first connection object is contacted with the contacting portion.

2. The contact according to claim 1, wherein the coupling portion extends in an annular shape around the axis.

3. The contact according to claim 1, wherein the coupling portion extends in a curved shape around the axis.

4. The contact according to claim 1, wherein the first projecting portion is adjacent to one of the butting portions in a second direction perpendicular to the axis and the first direction.

5. The contact according to claim 1, wherein another of the spring elements is provided with a second projecting portion which is cooperated with the first projecting portion to prevent the first connection object from moving in the removal direction along the axis.

6. The contact according to claim 1, further comprising a shape maintaining portion which maintains the coupling portion in the bent shape.

7. The contact according to claim 6, wherein the shape maintaining portion includes a fixing portion which is coupled to the coupling portion to fix the shape of the coupling portion.

8. The contact according to claim 6, wherein the shape maintaining portion consists of a joint which is formed at least one position of the coupling portion.

9. The contact according to claim 8, wherein the joint is formed by mutual engagement in a circumferential direction with respect to the axis.

10. The contact according to claim 8, wherein the coupling portion is formed into a generally rectangular cylindrical shape defining four surfaces, the spring elements extend from opposite ones of the four surfaces, respectively, the joint is formed on at least one of the remaining ones of the four surfaces.

11. An electrical connector comprising:

the contact according to claim 1; and a housing holding the contact.

12. The electrical connector according to claim 11, wherein the housing includes a shape maintaining portion which maintains the coupling portion in the bent shape.

13. A combination of the contact according to claim 1 and a shape maintaining portion which maintains the coupling portion in a bent shape, wherein the shape maintaining portion is a part of the board to which the contact is mounted.

14. The combination according to claim 13, wherein the connecting portion is fixed to the part of the board.

* * * * *

UNITED STATES PATENT AND TRADEMARK OFFICE

CERTIFICATE OF CORRECTION

PATENT NO. : 7,798,871 B2
APPLICATION NO. : 12/590587
DATED : September 21, 2010
INVENTOR(S) : Urano It is certified that error appears in the above-identified patent and that said Letters Patent is hereby corrected as shown below:

In particular, in Column 8, line 29, (Line 2 of Claim 8) please change "formed at least" to correctly read: --formed at at least--.

Signed and Sealed this

Sixteenth Day of November, 2010

David J. Kappos

David J. Kappos
*Director of the United States Patent and Trademark Office*